United States Patent [19]

Martiradonna

[11] 4,012,881

[45] Mar. 22, 1977

[54] ARCHITECTURAL MODULAR ELEMENTS FOR FORMING AND-OR COMPLETING MONUMENTS OR LIKE WORKS OF ART

[76] Inventor: Elio Martiradonna, via Stoppani 25, 20129 Milan, Italy

[22] Filed: Dec. 6, 1974

[21] Appl. No.: 530,408

[30] Foreign Application Priority Data

Dec. 14, 1973 Italy ..... 36146/73[U]

[52] U.S. Cl. ..... 52/604; 52/608

[51] Int. Cl.[2] ..... E04C 1/12; E04B 1/02

[58] Field of Search ..... 52/602–604, 52/574, 569, 608–611, 606, 663; 165/9.1, 9.2, 9.3, 9.4

[56] References Cited

UNITED STATES PATENTS

| | | | |
|---|---|---|---|
| 877,997 | 2/1908 | Henry | 52/570 |
| 1,574,584 | 2/1926 | Lindner | 165/9.1 |
| 1,976,575 | 10/1934 | MacDonald | 52/604 |
| 2,493,470 | 1/1950 | Tau | 52/604 |
| 2,622,864 | 12/1952 | Hasche | 52/604 |
| 3,090,163 | 5/1963 | Hauer | 52/663 |
| 3,221,459 | 12/1965 | Hamory | 52/604 |
| 3,316,683 | 5/1967 | Patton | 52/663 |

FOREIGN PATENTS OR APPLICATIONS

| | | | |
|---|---|---|---|
| 322,881 | 2/1903 | France | 52/590 |

*Primary Examiner*—James L. Ridgill, Jr.
*Attorney, Agent, or Firm*—Robert E. Burns; Emmanuel J. Lobato; Bruce L. Adams

[57] ABSTRACT

Architectural modular elements are described for making and/or finishing monuments or like works of art. The elements are provided by cutting valuable stones, marbles or the like and are in the form of blocks having flat faces of modular lengths at right angles to one another, or separated by cylindrical surfaces which are concave inwardly of the element and provided with properly designed bending radii, which concave cylindrical surfaces can be concerned with such center angles as larger, equal to or less than 90°.

6 Claims, 14 Drawing Figures

ARCHITECTURAL MODULAR ELEMENTS FOR FORMING AND-OR COMPLETING MONUMENTS OR LIKE WORKS OF ART

This invention is concerned with preformed modular elements, particularly provided by cutting valuable stones, marbles or the like, such elements being preformed according to modules enabling a plurality of architectural arrangements for constituting or finishing monuments or like works of art.

As well known, many are the problems encountered in forming or making up monuments of valuable stone, marble or the like, and therefore the resulting high costs due both to raw material being used and labour.

In order to overcome such disadvantages, the present invention proposes the use of preformed elements, particularly of valuable stones, marbles and the like, as mass-produced according to particular modules enabling infinite imagination arrangements thereof with extreme simplicity and easiness in assembling even for unskilled staff and labour with remarkable functional and aesthetical results.

Particularly, according to the present invention, the elements comprise blocks having flat faces of modular length which are at right angles to one another, or separated by cylindrical surfaces which are concave inwardly of the element with properly designed bending radii, wherein said concave cylindrical surfaces can be concerned with such center angles as larger, or equal to, or less than 90°.

Figure 2:
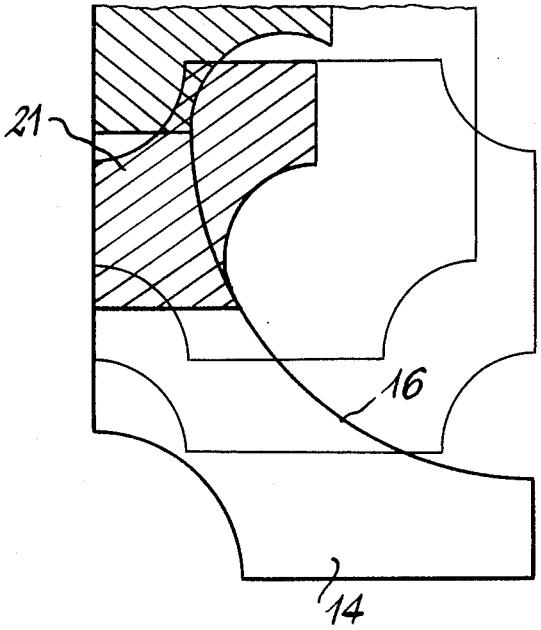
Figure 1:
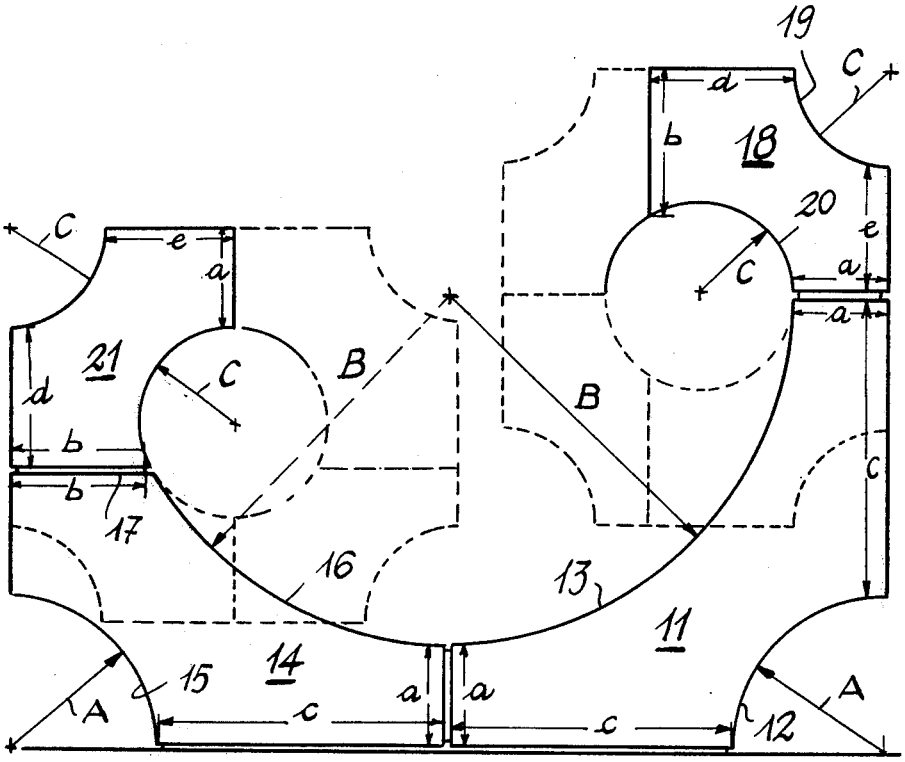

The present invention can be better understood from the following detailed description, as given by mere way of example, particularly referring to the accompanying drawings in which:

FIGS. 1 and 2 plan views showing the elements according to the present invention and particularly pointing out the features thereof, the capabilities of interassembling such elements, that is the composability and/or how these elements can be obtained by the same blocks of raw material; and FIGS. 3–14 are exemplary views depicting some of the arrangements or compositions being obtained by the elements according to the invention for forming or making up monuments or the like.

A first element according to the invention (see FIG. 1), designated as a whole by reference numeral 11, has sides of length *c* which are at right angles to one another, having therebetween a cylindrical surface 12, the latter being concave inwardly of the element and provided by a bending radius A which is concerned with a center angle of 90°. The two walls of length *c* have adjacent and perpendicular thereto two walls of length *a*, between which a surface 13 is provided as concave inwardly of the element and obtained by a bending radius B which is much larger than radius A. As apparent from the foregoing, the element 11 is perfectly symmetrical with respect to an axis passing through the bending centers of the two cylindrical surfaces.

A second element 14 has also a side of length *c* adjacent an inwardly concave cylindrical surface 15 having a bending radius A and concerning a center angle of 90°. Provision is also made for a side of length *a*, or simply side *a*, which is at right angles to side *c* and adjacent a cylindrical surface 16 having a concavity to the center of element 14 and radius B, but with the latter cylindrical surface now concerning an arc less than 90°, so that its upper side 17 is of a length *b* ($b > a$). In this case, as apparent, said element 14 would be not symmetrical.

The element 18 has a lower side of length *a* adjacent a side of length *e* ($e > a$) which is orthogonal thereto, the latter having adjacent thereto a cylindrical surface 19 which is concave inwardly of the element and has a bending radius C concerning a center angle of 90°. Said element 18 has also a side of length *d*, parallel with side *a* and adjacent the latter a cylindrical surface 20 which is concave to the center of the element with a bending radius C, but now concerning a center angle larger than 90°, so that the side parallel with side *e* is of a length *b*.

According to the present invention, the element 21 is completely indentical to the above described element 18, even though shown in FIG. 1 as rotated through 90° relative thereto.

The plan views of FIGS. 1 and 2 illustrate the modular length edges of length *a*, *b*, *c*, *d*, *e* and illustrate that these edges bound planar surfaces of the modular structural elements, however, the plan views do not reveal all of the side surfaces of the elements. The perspective views of FIGS. 3–14 show that the modular structural elements have a substantial extent in three dimensions, and that the side surfaces not shown in the plan views of FIGS. 1 and 2 are also planar surfaces so that the modular structural elements are completely bounded by planar surfaces and the concave cylindrical edge surface portions. As mentioned above, the modular length edges are perpendicular and consequently the planar surfaces bounded by the modular length edges are mutually perpendicular. For example, the modular structural element 11 illustrated in FIG. 1 has a surface comprised of a first pair of mutually perpendicular sides respectively bounded by the edges of modular length *a*, a first concave cylindrical edge surface portion 13 which intersects the first pair of mutually perpendicular sides, a second pair of mutually perpendicular sides respectively bounded by the edges of modular length *c* and each of which is perpendicular to and intersects a respective one of the first pair of mutually perpendicular sides, a second concave cylindrical edge surface portion 12 which intersects the second pair of mutually perpendicular sides, and an upper and a lower planar surface parallel to the plane of FIG. 1 and perpendicular to the first pair and second pair of planar surfaces. Each of the concave cylindrical surface portions has a longitudinal axis which is parallel to respective ones of the modular length edges and which is represented in FIG. 1 by a cross with a radius of curvature extending therefrom to the corresponding concave cylindrical surface portion.

In the arrangement of modular structural elements illustrated in FIG. 1, at least a pair of adjacent modular structural elements are positioned with adjacent planar surfaces thereof coextensive, and are positioned with the respective concave cylindrical edge portions of the adjacent blocks adjacent and smoothly merging with one another to jointly define a smoothly curved concave surface having a non-constant radius of curvature. For example, the adjacent modular structural elements 11, 18 shown in FIG. 1 are positioned so that their respective adjacent planar surfaces bounded by edges of modular length *a* are coextensive and relatively positioned so that the concave surface edge portion 20 of modular element 18 is adjacent to and merges smoothly with the concave surface edge portion 13 of modular element 11. Since the concave surface portion 20 has a radius of curvature of length C while the concave surface portion 13 has a radius of curvature B, the concave surface portions 13, 20 together jointly comprise a smoothly curved concave surface having a non-constant radius of curvature.

The modular structural elements according to the invention may have different cross-sections as shown in FIG. 1. These cross-sections can generally be defined with reference to a first pair of perpendicular intersecting planar surfaces which define a first corner of the crosssection, a second pair of perpendicular intersecting planar surfaces which define a second corner of the cross-section diagonally opposed to the first corner, a first concave cylindrical surface segment which intersects a pair of non-intersecting planar surfaces comprised of a planar surface from the first pair of perpendicular intersecting planar surfaces and of a planar surface from the second pair of perpendicular intersecting planar surfaces, and a second concave cylindrical surface segment intersecting the perpendicular pair of non-intersecting planar surfaces comprised of the remaining planar surfaces of said first and second pairs of perpendicular planar surfaces which are not intersected by the first concave cylindrical surface segment.

For example, the cross-section of modular structural element 18 shown in FIG. 1 includes a first corner defined by the intersection of the perpendicular intersecting planar surfaces bounded by edges of modular length *b*, *d*, respectively, and a second corner which is diametrically opposed to the first corner and defined by the intersection of the pair of perpendicular planar surfaces bounded by the edges of modular length *a*, *e*, respectively. A first concave cylindrical surface segment 19 intersects the perpendicular pair of non-intersecting planar surfaces comprised of the planar surfaces from the first pair of perpendicular intersecting planar surfaces which is bounded by the edge of modular length *d* and of a planar surface from the second pair of perpendicular intersecting planar surfaces which is bounded by the edge of modular length *e*. A second concave cylindrical surface segment 20 intersects the perpendicular pair of non-intersecting planar surfaces comprised of the remaining planar surfaces of the first and second pairs of perpendicular surfaces which are not intersected by the first concave cylindrical surface segment 19, i.e. the perpendicular pair of planar surfaces respectively bounded by the edges of modular length *b* and modular length *a*.

In the modular structural element 18 the first concave cylindrical surface segment 19 and the second concave cylindrical surface segment 20 have equal radii of curvature of length C. On the hand, the modular structural element 11 includes a first concave cylindrical surface segment 12 having a radius of curvature of length A, and a second concave cylindrical surface segment 13 having a radius of curvature of different length B. In the modular structural element 11 the first concave cylindrical surface segment 12 intersects the pair of perpendicular non-intersecting planar surfaces which are bounded by modular length edges of equal modular length *c*, and the second concave cylindrical surface segment 13 intersects the pair of perpendicular non-intersecting planar surfaces which are also bounded by modular length edges of equal modular length *a*. The adjacent concave cylindrical surface segments 13, 20 of the respective modular structural elements 11, 18 both intersect a modular length edge of equal modular length *a*. Therefore, when these modular structural elements are positioned adjacent as shown in FIG. 1 with their respective concave cylindrical surface segments 13, 20 merging smoothly to jointly comprise a smooth concave surface segment of non-constant radius of curvature, the respective adjacent planar surfaces of modular elements 11, 18, bounded by modular length edges of length *a*, are coextensive.

In FIGS. 1 and 2, further elements have been shown by broken lines, as obtainable according to the present invention in a mirror-like fashion with respect to the particularly described elements, or merely being complementary parts to the described elements, but also completely for use with the same principles.

From the foregoing it will be apparent, in combination with the appended drawings, that infinite architectural immagination compositions can be created particularly, but not exclusively, by using in the composition sides of different elements, all of the sides being of a same length. It will be apparent that such combinations are substantially infinite, should it being taken into account also the fact that for each side of equal length the elements can be arranged with a mirror-like symmetry or overturned thereto, and also that the aesthetical result would be completely different for each of the combinations, depending on the element side being preselected as a support.

Figure 3:
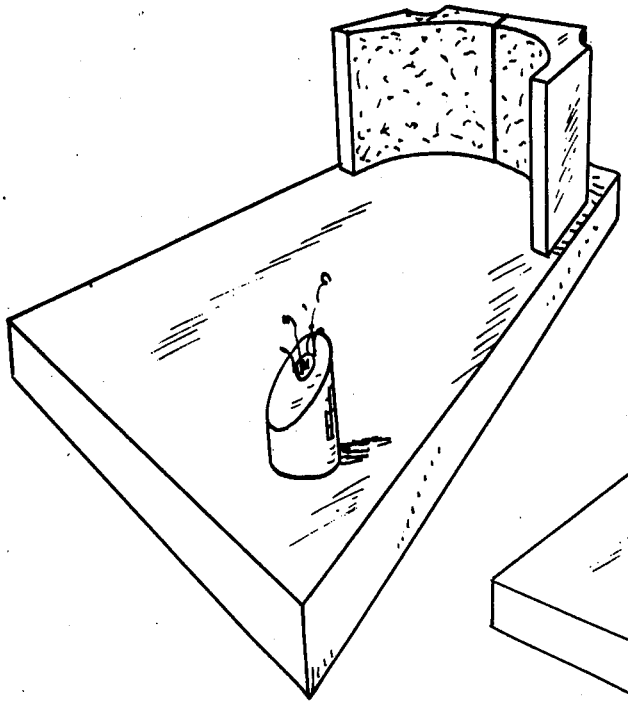
Figure 4:
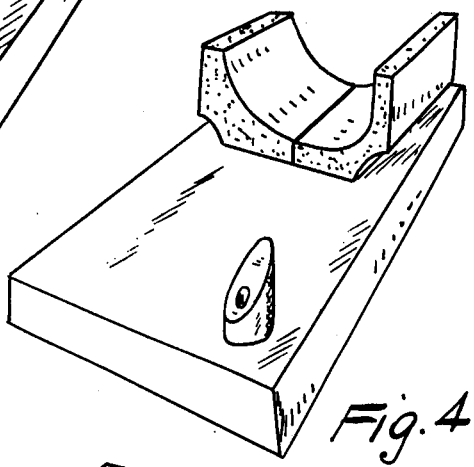
Figure 5:
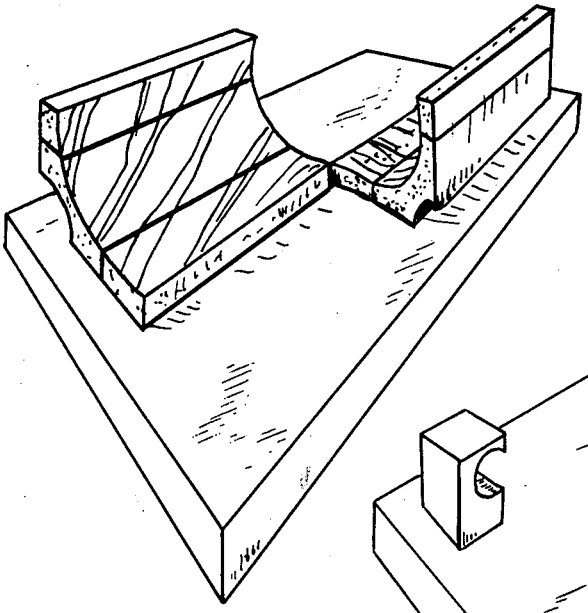
Figure 6:
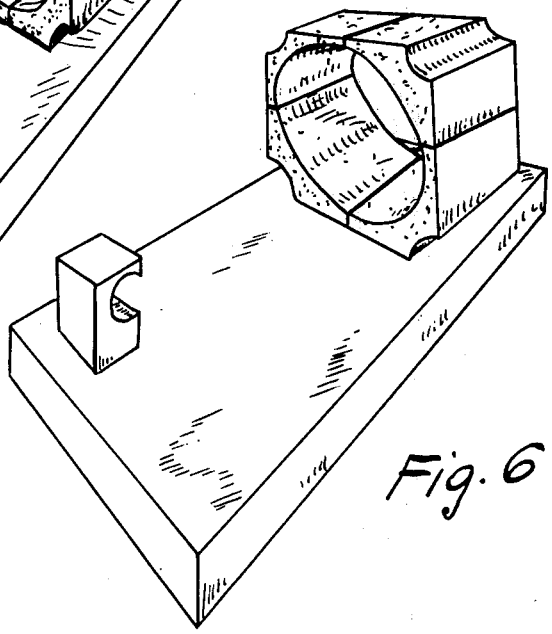
Figure 7:
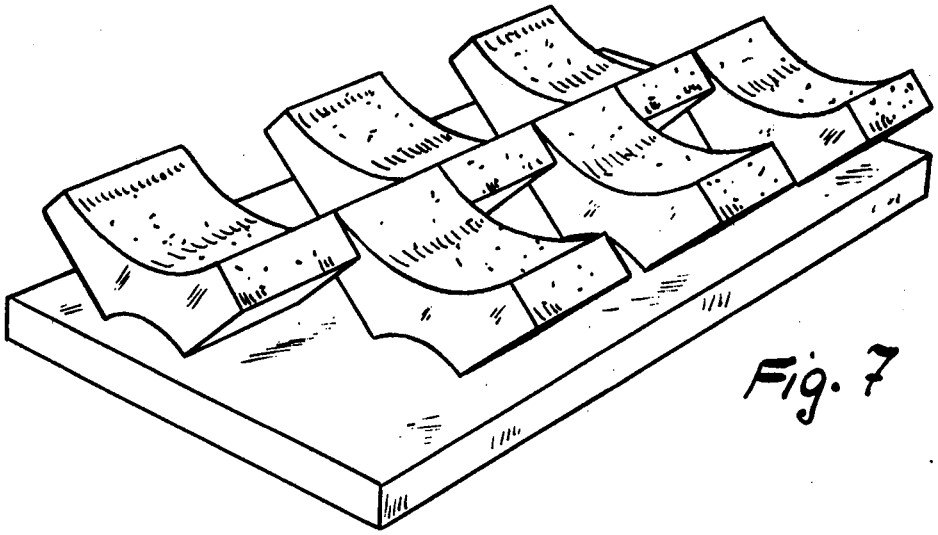

As above mentioned, FIGS. 3–14 show by way of not limiting example some of the combinations that can be obtained by the elements according to the present invention. Particularly, FIG. 3 shows a monument as obtainable by means of two simple elements 11 having sides *a* approached to one another and vertically arranged generatrices of the cylindrical surfaces, whereas FIG. 4 is a view showing a monument as obtainable by the same elements 11 having approached sides *a*, but with horizontally arranged generatrices of the cylindrical surfaces. The example, as shown in FIG. 6, depicts the use of four elements 11, again having sides *a*, as approached to one another, and horizontally arranged generatrices of the cylindrical surfaces, so as to make up a looped configuration.

Again with side only elements 11, such monuments can be obtained as shown shown in FIGS. 5, 7, 9, 10 and 14, clearly illustrating how the aesthetical result of the assembly can be modified by means of simple changes in the arrangement of the modular base elements.

Figure 8:
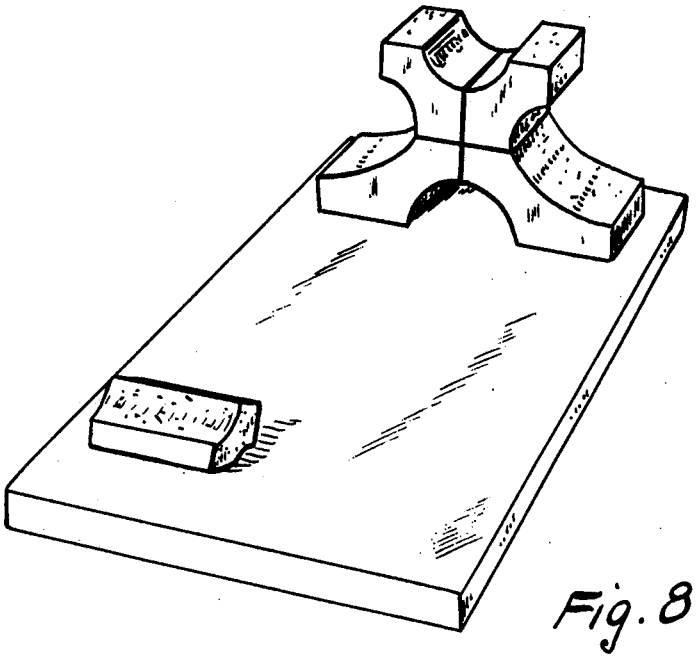
Figure 9:
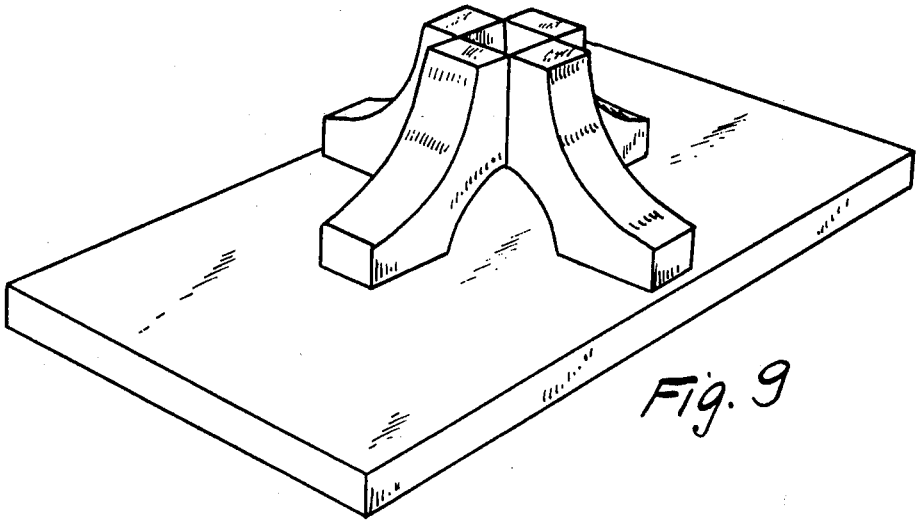
Figure 10:
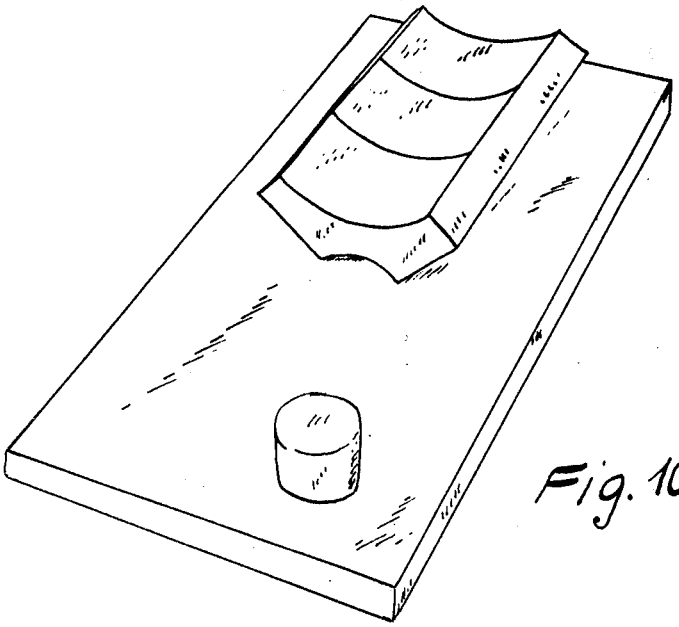
Figure 11:
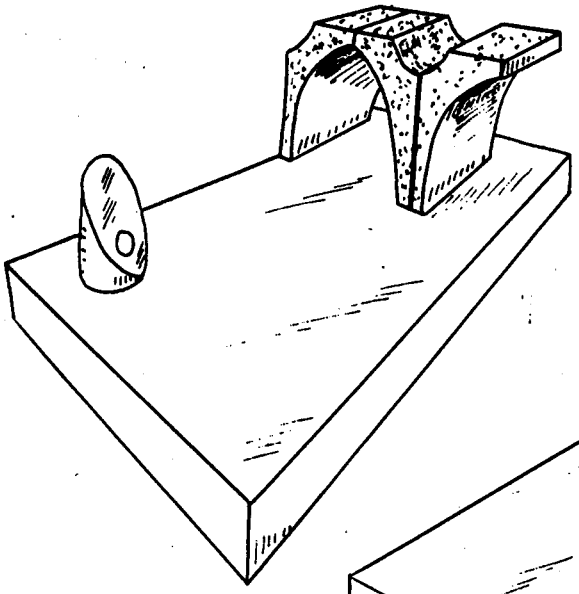
Figure 12:
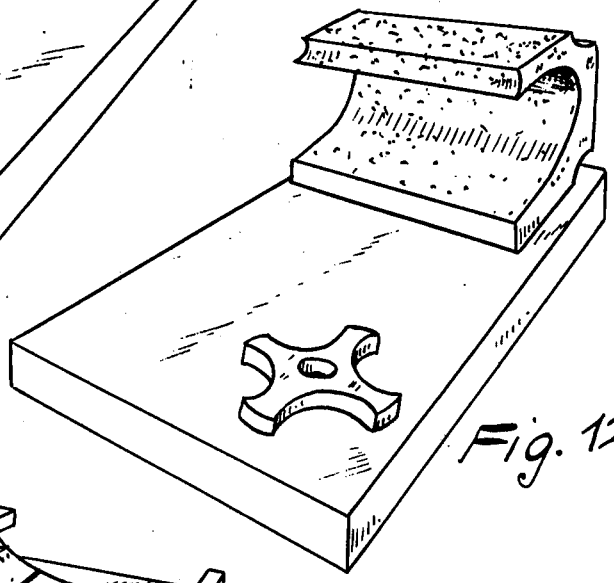
Figure 13:
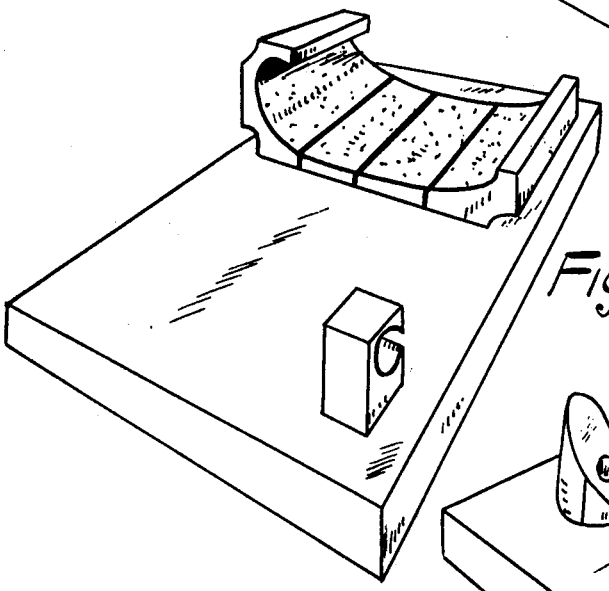
Figure 14:
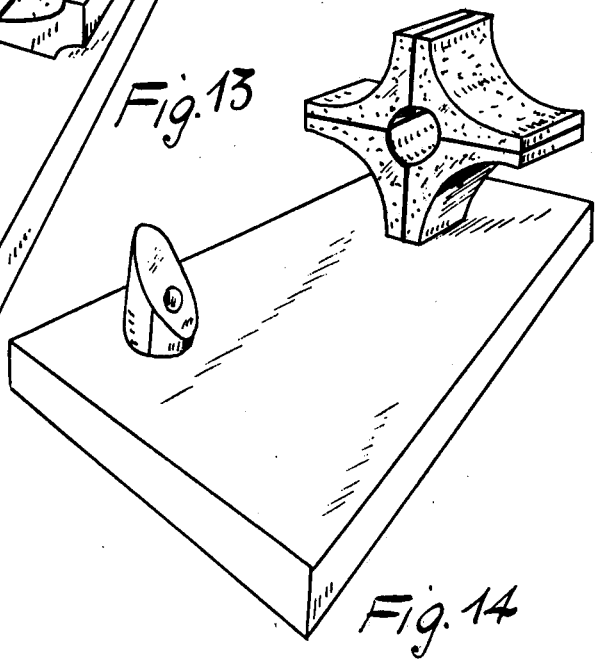

The examples associated with FIGS. 11, 12 and 13 illustrate the use of variously arranged asymmetric elements 14, whereas FIG. 8 shows an exemplary composite use of elements 14 and elements 18 or 21.

It should be noted that one of the peculiar features of the present invention resides in the maximum exploitation of the material used for forming the individual elements, and this because of the modular and dimensional characteristics thereof in addition to the complementary properties of the shapes thereof. Substantially, from a block, or even from a scrap of other works, modular elements according to the present invention can be always obtained with minimal waste.

Obviously, it will appear that the size, materials being used, as well as the particular embodiments for the elements according to the present invention could be selected in a wide range, depending on the use requirements.

What I claim is:

1. A combination comprised of: a plurality of modular structural elements each comprising a block having a substantial extent in three dimensions and defined by a plurality of mutually perpendicular planar surfaces intersecting at right angles to defining modular lengths edges of said block, and at least one concave cylindrical surface segment having a longitudinal axis of modular length and positioned with the longitudinal axis parallel to respective ones of the modular length block edges and intersecting a perpendicular pair of said planar surfaces to define a concave cylindrical edge portion of said block; adjacent ones of said modular structural elements being positioned with adjacent respective planar surfaces thereof coextensive and with the respective modular length edges bounding the adjacent coextensive planar surfaces positioned so that the respective concave cylindrical edge portions of the adjacent blocks are adjacent and smoothly merge with one another jointly defining a smoothly curved concave surface having a non-constant radius of curvature.

2. A combination according to claim 1, wherein at least one of said modular structural elements has a transverse cross section defined by a first pair of perpendicular intersecting planar surfaces defining a first corner of the cross section, a second pair of perpendicular intersecting planar surfaces defining a second corner of the cross section diagonally opposed to said first corner, a first concave cylindrical surface segment intersecting a perpendicular pair of non-intersecting planar surfaces comprised of a planar surface from said first pair of perpendicular intersecting planar surfaces and of a planar surface from said second pair of perpendicular intersecting planar surface to define a first circular corner segment of the cross section, and a second concave cylindrical surface segment intersecting the perpendicular pair of non-intersecting planar surfaces comprised of the remaining planar surfaces of said first and second pairs of perpendicular planar surfaces not intersected by said first concave cylindrical surface segment to define a second circular corner segment of the cross section diagonally opposed to said first circular corner segment.

3. A combination according to claim 2, wherein said first and second concave cylindrical surface segments have equal radii of curvature.

4. A combination according to claim 2, wherein said first and second concave cylindrical surface segments have unequal radii of curvature.

5. A combination according to claim 2, wherein the pair of perpendicular non-intersecting planar surfaces intersected by said first concave cylindrical surface segment are equal in length, and wherein the pair of perpendicular non-intersecting planar surfaces intersected by said second concave cylindrical surface segment are equal in length.

6. A combination according to claim 5, wherein another of said modular structural elements has a transverse cross section defined by a concave cylindrical surface segment having a radius of curvature different from said first concave cylindrical surface segment of said at least one modular structural element, and wherein a planar surface of said another modular structural element intersected by said concave cylindrical surface segment thereof is equal in length to a planar surface of said at least one modular structural element intersected by said first concave cylindrical surface segment thereof.

* * * * *